US005627130A

United States Patent [19]

Bailey et al.

[11] Patent Number: 5,627,130

[45] Date of Patent: May 6, 1997

[54] SLIPPING LAYER FOR DYE-DONOR ELEMENT USED IN THERMAL DYE TRANSFER

[75] Inventors: David B. Bailey; Linda Kaszczuk, both of Webster, N.Y.

[73] Assignee: Eastman Kodak Company, Rochester, N.Y.

[21] Appl. No.: 633,238

[22] Filed: Apr. 16, 1996

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/447, 913, 914; 503/227

[56] References Cited

U.S. PATENT DOCUMENTS 5,252,534 10/1993 DePalma et al. ..... 503/227

*Primary Examiner*—B. Hamilton Hess
*Attorney, Agent, or Firm*—Harold E. Cole

[57] ABSTRACT

A dye-donor element for thermal dye transfer comprising a support having on one side thereof a dye layer and on the other side a slipping layer comprising a polyvinyl-block-siloxane copolymer, the polysiloxane component comprising from about 2 to about 30 weight % of the copolymer, and the polysiloxane component having a molecular weight of at least about 3900.

18 Claims, No Drawings

SLIPPING LAYER FOR DYE-DONOR ELEMENT USED IN THERMAL DYE TRANSFER

This invention relates to dye-donor elements used in thermal dye transfer, and more particularly to the use of certain silicone copolymers on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are them transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head. A defect in the performance of that layer causes intermittent rather than continuous transport across the thermal head. The dye transferred thus does not appear as a uniform area, but rather as a series of alternating light and dark bands (chatter marks).

Another desirable performance characteristic for a slipping layer is a smooth transfer across a wide range of printing conditions. Variable print forces along either the length or width of a print could cause image defects. Differences in print forces are especially magnified in regions of abrupt temperature change. At the transition from Dmax to Dmin, the force may spike upward from Dmax to a peak force and then return to Dmin. This differential is referred to as "pops" since an audible popping noise can be heard in extreme cases.

In addition to printing performance, a slipping layer should be of low cost and be coatable from an amenable coating solvent. Halogenated solvents are among the least desirable for environmental reasons.

U.S. Pat. No. 5,252,534 disclose a heat-resistant layer on the back surface of a thermal dye-donor element comprising a polyimide-siloxane copolymer which is formed by a condensation polymerization. While these materials have been effective, there is a problem in that a condensation polymerization often requires anhydrous conditions and an exact balance of purified reagents which can be difficult to achieve. In addition, such polymers are principally soluble in halogenated solvents which are hazardous to the environment.

It is an object of this invention to provide a siloxane copolymer for a dye-donor slipping layer which can be made to high molecular weight without the rigorous purity required for condensation polymerizations and which is soluble in less hazardous solvents such as ketones. It is another object of this invention to provide a siloxane copolymer for a dye-donor slipping layer which can be made from vinyl monomers which are readily available and relatively inexpensive.

These and other objects are achieved in accordance with this invention which relates to a dye-donor element for thermal dye transfer comprising a support having on one side thereof a dye layer and on the other side a slipping layer comprising a polyvinyl-block-siloxane copolymer, the polysiloxane component comprising from about 2 to about 30 weight % of the copolymer, and the polysiloxane component having a molecular weight of at least about 3900.

The above copolymers have the appropriate physical properties to provide good lubrication across the range of the printing temperatures, thereby allowing good transport through a thermal printer, and can function as the only component of a slipping layer without the need to add solid particles, liquid additives, or to crosslink the polymer with its attendant disadvantages.

In a preferred embodiment of the invention, the vinyl-block-siloxane copolymer contains recurring units having the structural formula:

$$+A+-+B+$$

wherein:

A represents a vinyl polymer such as an acrylate, methacrylate, acrylamide, styrene, hydroxystyrene, vinyl pyrollidinone, maleic anhydride, N-substituted maleimides, vinyl ethers, etc; and B represents a group having the structural formula:

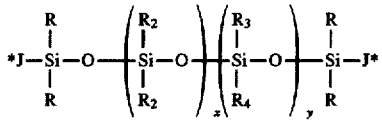

wherein:

each J represents

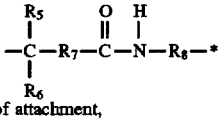

* represents the point of attachment,

R, $R_1$, $R_2$, $R_3$, and $R_4$ each independently represents a substituted or unsubstituted alkyl or fluoroalkyl group having from 1 to about 5 carbon atoms, or a substituted or unsubstituted aryl group having from 6 to about 12 carbon atoms;

$R_5$ and $R_6$ each independently represents a substituted or unsubstituted alkyl group having from 1 to about 5 carbon atoms, a substituted or unsubstituted aryl group having from 6 to about 12 carbon atoms, a halogen, or cyano;

$R_7$ and $R_8$ each independently represents a substituted or unsubstituted alkyl group having from 1 to about 5 carbon atoms, a substituted or unsubstituted aryl group having from 6 to about 12 carbon atoms; and the values of x and y are each from 0 to about 400, with the proviso that x+y is from 50 to about 400.

In a preferred embodiment of the invention, R, $R_1$, $R_2$, $R_3$, $R_4$ and $R_5$ are each methyl, $R_6$ is cyano, $R_7$ is $—CH_2CH_2—$, and $R_8$ is $—CH_2CH_2CH_2—$.

The overall molecular weight of the above copolymer, in general, is from about 40,000 to about 1,000,000. In a preferred embodiment of the invention the glass transition temperatures of the copolymers are greater than about 100° C.

Slipping layers based on vinyl copolymers containing bound polydimethylsiloxane (PDMS) segments have been prepared by initiating vinyl polymerization with an oligomeric silicone-initiator. Using this approach, the silicone segment is incorporated as a block or main chain segment rather than as a pendant graft. In another preferred embodiment of the invention, the polyvinyl-block-silicone copolymer is derived from a vinyl monomer and a macroazo polydimethylsiloxane initiator.

The poly(dimethylsiloxanes) which are part of the copolymers employed in the invention are available commercially such as SWS F881-A, mol. wt. 1700; SWS F881-B, mol. wt. 3900; and SWS F881-C, mol. wt. 7400; (Waker Silicones Co.); PS-510, mol. wt. 2500; and PS-513, mol. wt. 27,000; (Huls America Co.); and X2-2616, mol. wt. 14,000 (Dow Corning).

The siloxane copolymer defined above can be employed in the invention herein at any concentration useful for the intended purpose. In general, good results have been obtained at a concentration of about 0.05 to about 1.0 $g/m^2$, preferably about 0.3 to about 0.6 $g/m^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumickaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumicacryl Blue 6G® (Sumitomo Chemical Co., Ltd.), and Aizen Malachite Green® (Hodogaya Chemical Co., Ltd.);

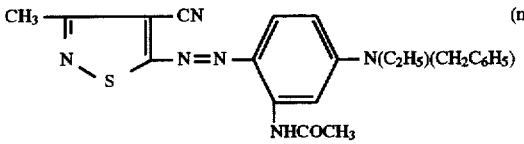

(magenta)

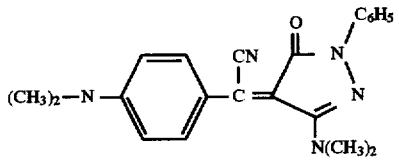

(magenta)

-continued

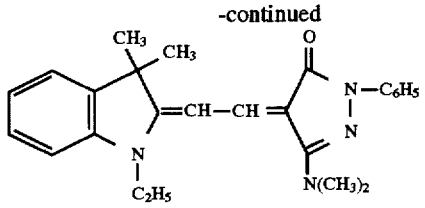

(yellow)

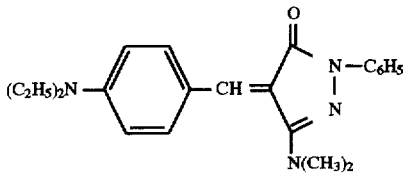

(yellow)

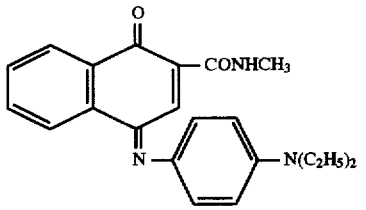

(cyan)

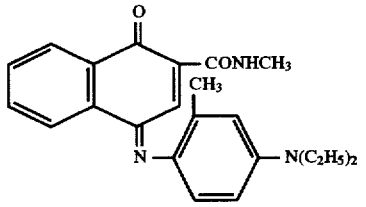

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 $g/m^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly (tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 mm. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 $g/m^2$.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

Polymer 1- Preparation of Macroazo Silicone Initiator

The macroazo initiator was prepared by converting 4,4'-azobis(4-cyanovaleric acid) to the activated bis p-nitrobenzoate ester. The ester was then reacted with an amino-terminated PDMS in a two-phase toluene-DMAc reaction. The macroazo initiator was precipitated into methanol and extracted repeatedly with methanol to remove residual p-nitrophenol. The molecular weight of the resultant polymer was about four to seven times greater than that of the starting PDMS which indicates about seven PDMS-azo couplings. The end groups of the macro azo chain were a combination of PDMS groups and azo groups. The majority of the azo groups were within the chain and were flanked by two PDMS segments. Each azo moiety represented a potential growth site for a vinyl segment. PDMS chains of 5,000 and 14,000 molecular weight have been used. A typical reaction scheme is shown below:

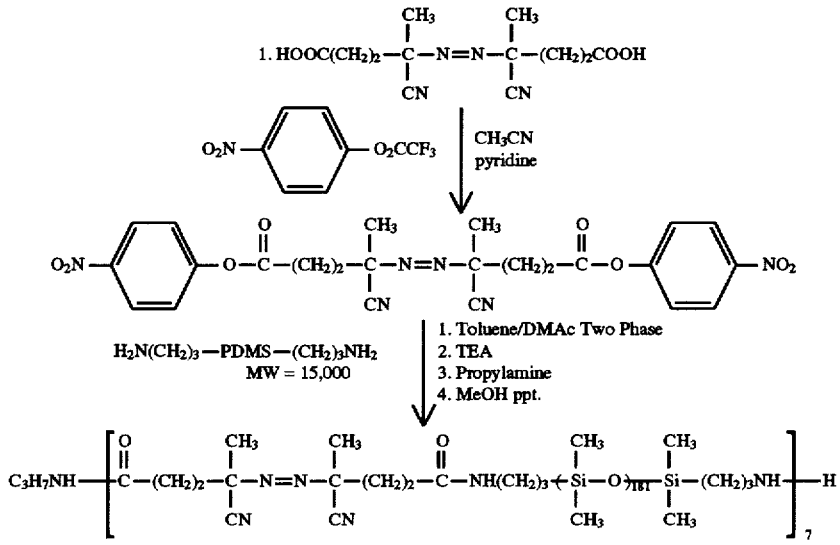

P-Nitrophenyl ester of 4-4' azobis(4-cyanovaleric acid)

A 500 mL 3NRB flask fitted with a thermometer, condenser and an argon purge was charged with 33.3 g trifluoroacetic anhydride, 15.5 g p-nitrophenol and 22.2 ml of toluene. The p-nitrophenol dissolved as the mixture was stirred and heated to reflux. The condenser was then replaced with a distillation apparatus and the trifluoroacetic acid, excess trifluoroacetic anhydride, and toluene were distilled off. Heating was discontinued when the pot temperature had reached 160° C. The crude p-nitrophenyl trifluoroacetate (25.6 g, 98%) was a dense pale yellow liquid.

The p-nitrophenyl trifluoroacetate was cooled to room temperature and the flask was charged with 270 ml acetonitrile, 13.7 gram 4-4' azobis(4-cyanovaleric acid), and 72 ml pyridine. The mixture was heated to 50° C. for several minutes to dissolve the 4-4' azobis(4-cyanovaleric acid) and was then quickly cooled to room temperature. The product crystallized as the solution was stirred overnight at room temperature under argon. The crystals were isolated by filtration, washed with 100 ml of acetonitrile and air-dried on the filter. Yield=93%. Structure was confirmed by $^1$HNMR run in dimethyl sulfoxide (DMSO)$D_6$. The product was stored cold.

PDMS-azo initiator

A 250 mL 3NRB flask fitted with a mechanical stirrer and an argon purge was charged with 20.9 g bisaminopropyl PDMS, 18 ml toluene, 0.44 g triethylamine (TEA) 15 ml N,N'dimethylacetamide (DMAC) and 0.81 g of the p-nitrophenyl ester of 4,4' azobis(4-cyanovaleric acid). The yellow, viscous reaction mixture has three phases: a toluene-rich PDMS layer, a DMAC solution of the bis(p-nitrophenyl) ester, and some insoluble bis(p-nitrophenyl) ester. The insoluble fraction gradually dissolved with stirring over 20 hours at room temperature.

Propylamine (0.22 g) was then added and allowed to react for 1 hour to convert all remaining p-nitrophenyl ester groups to N-propyl amides. Addition of 50 ml of methanol to the reaction mixture precipitated a very soft polymer. The yellow methanol layer was decanted and the gummy precipitate kneaded with a series of four 50 ml methanol washes to extract p-nitrophenol. Each subsequent wash was less yellow but never entirely colorless. The resulting soft polymer was dissolved in toluene to 20% solids and stored cold. Mw by GPC of the PDMS-azo was 78,300 as compared to 16,800 for the starting PDMS, indicating about 4–5 PDMS-azo couplings. Gas chromatography showed the presence of a small amount of p-nitrophenol.

Polymerization of Vinyl Monomers Using Macroazo Silicon Initiator

The general polymerization procedure was to dissolve the appropriate monomers and the macroazo initiator in a solvent (methyl ethyl ketone or toluene for example), purge with argon and heat to 70° C. for 16 hours. The half-life for the azo group was estimated to be about 4 hours at 70° C. and about 12 hours at 60°

In the case of slowly polymerizing monomers, the azo groups were consumed before the monomer polymerized completely. For example, styrene reached only 20% conversion by the time the azo groups were consumed. Methyl methacrylate reached 40 to 50%. Consequently, the isolated polymer was richer in PDMS than the original charge. In the case of monomers which polymerized rapidly (maleimide copolymers with styrene or vinylpyrollidinone, >95% in ~10 hours), the monomer was consumed before all the azo groups had been used up. In this case there may have been residual azo groups left in the final polymer.

A useful feature of an oligomeric initiator is that on average only one of the several azo groups in the macro initiator has to be incorporated into the vinyl structure to bind all of the PDMS. A PDMS sequence may be flanked by two unreacted azo groups, but is nevertheless connected to a growing vinyl chain if any of the other azos in the macro initiator oligomer have initiated a chain. Therefore, on a statistical basis, all of the PDMS sequences can be incorporated into the vinyl structure even at low conversions. A PDMS macromonomer approach, on the other hand, is less efficient for incorporating PDMS. With macromonomers, high and, in some cases, impractical monomer conversions are needed for complete incorporation.

The final polymer structure achieved with a macroazo initiator may consist of long multiple sequences of PDMS in the main chain and some vinyl homopolymer. Not all azo groups lead to a growth site. From 30 to 40% may recombine (cage recombination) to give PDMS coupled directly to PDMS. Therefore, PDMS sequences longer than the original PDMS may result. In addition, the growing vinyl chains may terminate by disproportionation or by recombination. The final structure is a multisegmented block PDMS-vinyl copolymer.

8% PDMS-1-Vinyl-2-Pyrrolidinone/N-Cyclohexylmaleimide

A 2L 3NRB flask fitted with a condenser, argon purge and mechanical stirrer is charged with 158 g of a 20% (w/w) PDMS-azo initiator solution in toluene, 586 g of toluene, 139 g of 1-vinyl-2-pyrrolidinone, and 224 g of N-cyclohexylmaleimide. The reaction flask is purged with argon and then heated at 70° C. for 24 hours. The polymer is precipitated from isopropanol, filtered and air dried to yield 85–90%. Mn and Mw by GPC are 87,000 and 170,000, respectively, PDMS by Neutron Activation Analysis is 5.5%; the Tg of the copolymer is 239° C. and TGA=307° C.

A wide variety of monomers have been polymerized and copolymerized with the macro azo initiator. The following list shows the copolymers and their % PDMS contents as employed in the test and comparative samples.

| SAMPLE | COPOLYMER STRUCTURE | % PDMS |
|---|---|---|
| E-1 | $\leftarrow CH_2-C(CH_3)(CO_2CH_2CH(CH_3)_2)\rightarrow\leftarrow PDMS\rightarrow$ | 10.3 |
| E-2 | $\leftarrow CH_2-C(CH_3)(CO_2C_2H_5)\rightarrow\leftarrow PDMS\rightarrow$ | 7.4 |

-continued
| SAMPLE | COPOLYMER STRUCTURE | % PDMS |
|---|---|---|
| E-3 | 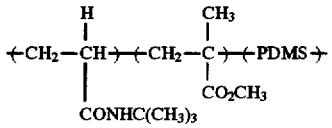 | 12.0 |
| E-4 | 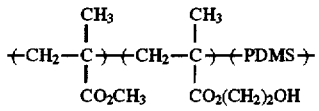 | 9.9 |
| E-5 | 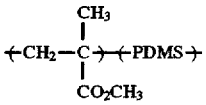 | 9.8 |
| E-6 | 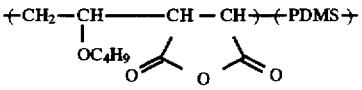 | 3.6 |
| E-7 | 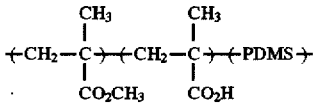 | 10.4 |
| E-8 | 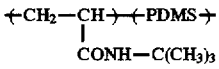 | 7.7 |
| E-9 | 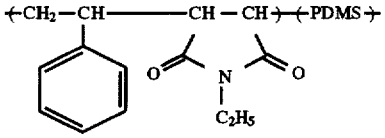 | 5.4 |
| E-10 | 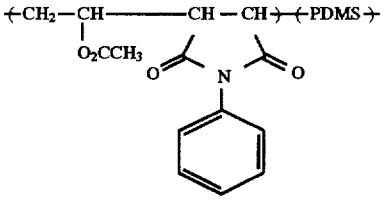 | 9.9 |
| E-11 | 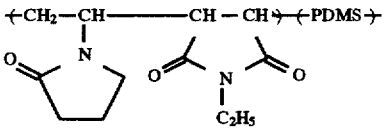 | 6.3 |
| E-12 | 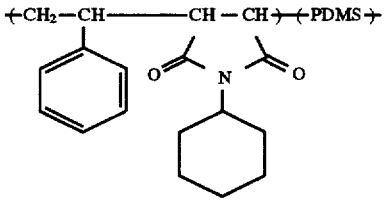 | 6.7 |
| E-13 | 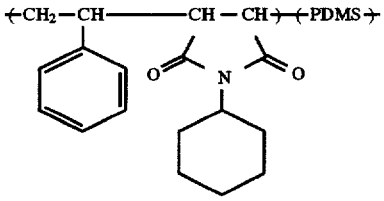 | 10.2 |

-continued
| SAMPLE | COPOLYMER STRUCTURE | % PDMS |
|---|---|---|
| E-14 | 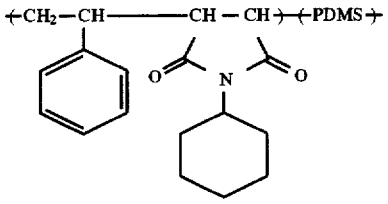 | 13.3 |
| E-15 | 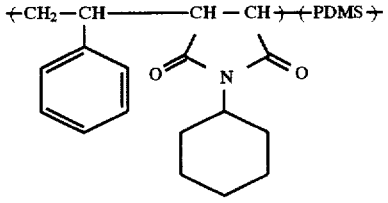 | 15.5 |
| E-16 | 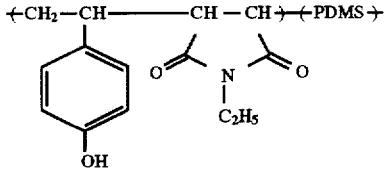 | 4.8 |
| E-17 | 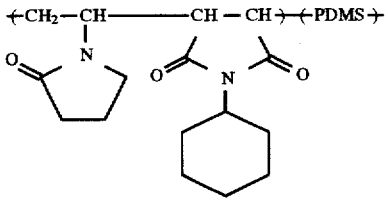 | 5.5 |
| E-18 | 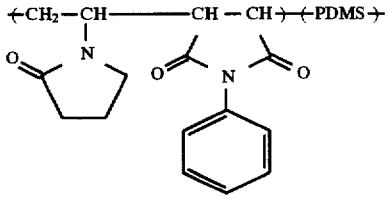 | 8.2 |
| C-1* | 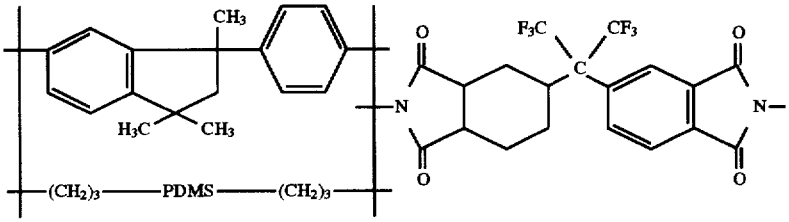 | 4.7 |
| C-2 | 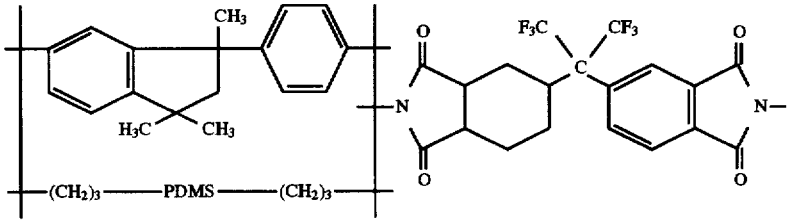 | 10.7 |

-continued

| SAMPLE | COPOLYMER STRUCTURE | % PDMS |
|---|---|---|
| C-3 | 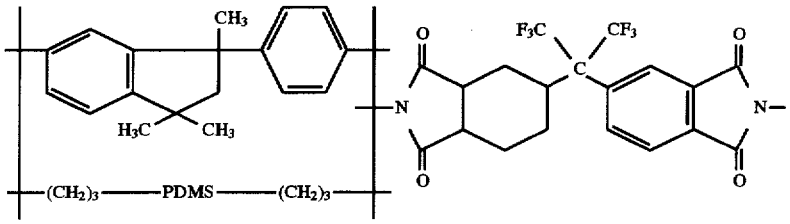 | 18.8 |

*C-1 through C-3 represent comparison samples.

The physical properties of the above copolymers are given in the following table:

TABLE 1

| SAMPLE DESIGNATION | % PDMS | Mw | Tg (°C.) | TGA (°C.) |
|---|---|---|---|---|
| E-1 | 10.3% | 496,000 | 69 | 208 |
| E-2 | 7.4% | 570,000 | 74 | 241 |
| E-3 | 12.0% | 593,000 | 118 | 364 |
| E-4 | 9.9% | 300,000 | 125 | 277 |
| E-5 | 9.8% | 656,000 | 126 | 344 |
| E-6 | 3.6% | 227,000 | 126 | 252 |
| E-7 | 10.4% | 432,000 | 135 | 363 |
| E-8 | 7.7% | 41,000 | 136 | 336 |
| E-9 | 5.4% | 394,000 | 178 | 375 |
| E-10 | 9.9% | 389,000 | — | 272 |
| E-11 | 6.3% | 238,500 | 206 | 305 |
| E-12 | 6.7% | 548,000 | 207 | 389 |
| E-13 | 10.2% | 380,000 | 207 | 389 |
| E-14 | 13.3% | 379,000 | 207 | 389 |
| E-15 | 15.5% | 364,000 | 207 | 389 |
| E-16 | 4.8% | 475,000 | 224 | 399 |
| E-17 | 5.5% | 170,000 | 239 | 305 |
| E-18 | 8.2% | 133,000 | — | 284 |
| C-1 | 4.7% | — | — | — |
| C-2 | 10.7% | — | — | — |
| C-3 | 18.8% | — | — | — |

Preparation of Donor Test Samples

Dye-donor elements were prepared by applying a subbing layer of Tyzor TBT® (titanium tetrabutoxide from DuPont) (0.13 g/m$^2$) to a Mylar® film (poly(ethylene terephthalate) from DuPont) (6.25 μm). The so prepared substrate was then patch-coated with the yellow, magenta, and cyan formulations described below producing a thermal dye transfer donor material as known in the art.

The donor dye formulations and their material laydowns (in g/m$^2$) were as follows:

yellow dye formulation 0.26 first yellow dye illustrated above
0.14 CAP 482-20 (a cellulose acetate propionate of 20 s viscosity, Eastman Chemical Co.)
0.07 CAP 482-0.5 (a cellulose acetate propionate of 5 s viscosity, Eastman Chemical Co.)
0.01 S363 N-1 (a micronized blend of polyethylene, polypropylene, and oxidized polyethylene particles, Shamrock Technologies, Inc.)
0.002 Fluorad ® FC-430 (a fluorosurfactant, 3M Corp.)
coated from a 60:40 toluene/isopropanol solvent mixture;

magenta dye formulation 0.14 first magenta dye illustrated above
0.15 second magenta dye illustrated above
0.24 CAP 482-20

-continued 0.08 CAP 482-0.5
0.11 S363-N1
0.002 Fluorad ® FC-430
coated from a 65:30:5 toluene/methanol/cyclopentanone solvent mixture;

cyan dye formulation 0.37 first cyan dye illustrated above
0.11 second cyan dye illustrated above
0.28 CAP 482-20
0.07 CAP 482-0.5
0.02 S363-N1
0.002 Fluorad ® FC-430
coated from a 60:40 toluene/isopropanol solvent mixture.

Test slipping layers according to the invention were coated onto the backside (opposite to the dye layers) of the above described dye-donor; they were coated at 0.32 g/m$^2$ from methyl ethyl ketone onto a subbing layer of 0.13 g/m$^2$ Tyzor® TBT on the backside of the Mylar® substrate. The films were dried at 28° C. for three minutes.

Preparation Of Dye-Receiver Element

The dye-receiver element used in the experimental work was prepared by extrusion-laminating a paper core with a 38 μm thick microvoided composite film (OPPalyte® 350 TW, Mobil Chemical Co.) as disclosed in U.S. Pat. No. 5,244,861. The composite film side of the resulting laminate was then coated with a dye-receiving layer as described in U.S. Pat. No. 5,262,378, Example 3, col. 6 lines 14 through 36.

Printing and Force Measurements

The test donor samples with copolymer slipping layers applied as described were subjected to conventional testing for the force needed to transport the donor/receiver combination past a thermal print head as follows:

The dye side of the above donor set element strip was placed in contact with the dye-receiving layer of the same area. This assembly was clamped to a stepper motor driving a 60 mm diameter rubber roller. Next, a TDK Model L-231 thermal head, thermostatted at 28° C. was pressed against the slipping layer side of the assembly with a force of 24.75 newton (5.5 lbs) pushing it against the rubber roller.

The imaging electronics were activated causing the donor/receiver assemblage to be drawn between the print head and roller. At the same time the resistive elements in the thermal print head were pulsed for 128 microsec/pulse at 134 microsecond intervals during the 4.575 millisec/dot printing time. A stepped density image was generated incrementally increasing the number of pulses/dot from 0 to 32 (Dmin to Dmax). The voltage supplied to the print head was approximately 13 volts, resulting in a maximum total energy of approximately 1.45 mJ/dot.

As each area test pattern of given density was being generated, the torque required to draw the assemblage through the print nip was measured with a Himmelstein Corp. Model 3-308TL (16-1) Torquementer (1.09 meter-Newton range) and Model 6.201 Conditioning Module. Print forces below 10 newton are generally acceptable. Data were taken at 0 pulses/dot (Dmin), 8 pulses/dot (Dmid), and at 32 pulses/dot (Dmax). The results are shown in the following table:

TABLE 2

| SAMPLE | Pops | Print Forces (newton) at Dmax | Dmid | Dmin |
|---|---|---|---|---|
| E-1 | 5.85 | 6.71 | 4.77 | 1.62 |
| E-2 | 5.85 | 7.47 | 5.13 | 2.43 |
| E-3 | 5.04 | 5.54 | 3.96 | 1.62 |
| E-4 | 4.68 | 5.94 | 2.79 | 1.62 |
| E-5 | 4.68 | 7.47 | 3.96 | 3.20 |
| E-6 | 3.91 | 5.13 | 2.43 | 1.26 |
| E-7 | 3.11 | 5.54 | 4.37 | 3.20 |
| E-8 | 4.68 | 5.54 | 4.77 | 2.03 |
| E-9 | 3.91 | 5.94 | 3.20 | 2.79 |
| E-10 | 3.51 | 4.77 | 2.43 | 1.62 |
| E-11 | 3.11 | 4.77 | 3.20 | 2.03 |
| E-12 | 2.75 | 4.77 | 2.43 | 2.03 |
| E-13 | 2.75 | 6.71 | 5.13 | 4.23 |
| E-14 | 2.34 | 5.94 | 4.37 | 4.37 |
| E-15 | 2.75 | 4.37 | 2.43 | 2.03 |
| E-16 | 2.34 | 4.77 | 2.43 | 2.43 |
| E-17 | 1.58 | 3.60 | 2.03 | 2.43 |
| E-18 | 0.41 | 2.43 | 2.43 | 3.20 |
| C-1 | 2.34 | 3.60 | 1.62 | 2.03 |
| C-2 | 2.34 | 4.37 | 2.43 | 2.03 |
| C-3 | 2.75 | 4.37 | 2.43 | 1.26 |

The above results show that the vinyl copolymers with polyimide copolymers shows print forces well below 10 newton. Pops for these polymers is also low and compares favorably with the comparison copolymers C-1–C-3.

A similar force test was run using a TDK Model LV5406A thermal head thermostatted at 35° C. This assemblage used a 1.80 cm (0.71 inch) diameter platen drive roller rather than a sample clamped to a stepper motor-driven 60 mm diameter rubber roller. A force of 65.25 newton was used to press the thermal head against the slipping layer side of the assemblage pushing it against the platen roller.

The resistive elements in the thermal print head were pulsed for 63.75 microsec/pulse at 74.39 microsec intervals during the 5.005 millisec/dot printing time. The number of pulses/dot ranged from 0 to 64 (Dmin to Dmax). The voltage supplied to the print head was approximately 14 volts, resulting in a maximum total energy of approximately 0.235 mJ/dot. The following results were obtained:

TABLE 3

| SAMPLE | Pops | Print Forces (newton) at Dmax | Dmid | Dmin |
|---|---|---|---|---|
| E-1 | 4.64 | 8.46 | 3.65 | 3.78 |
| E-2 | 6.08 | 9.98 | 4.73 | 3.87 |
| E-3 | 4.19 | 7.88 | 3.74 | 3.33 |
| E-4 | 3.51 | 8.28 | 3.60 | 4.73 |
| E-5 | 3.20 | 8.55 | 3.78 | 5.36 |
| E-6 | 3.83 | 7.25 | 4.05 | 3.83 |
| E-7 | 3.42 | 7.92 | 4.23 | 5.27 |
| E-8 | 3.87 | 8.60 | 4.50 | 4.50 |
| E-9 | 1.85 | 8.78 | 5.36 | 6.35 |
| E-10 | 2.25 | 6.62 | 3.69 | 4.46 |
| E-11 | 0.77 | 7.01 | 3.33 | 4.82 |
| E-12 | 2.21 | 8.33 | 5.49 | 6.48 |
| E-13 | 1.17 | 6.35 | 3.60 | 5.63 |

TABLE 3-continued

| SAMPLE | Pops | Print Forces (newton) at Dmax | Dmid | Dmin |
|---|---|---|---|---|
| E-14 | 1.53 | 8.37 | 5.90 | 6.89 |
| E-15 | 0.63 | 8.15 | 5.10 | 6.93 |
| E-16 | 1.53 | 8.24 | 5.58 | 6.66 |
| E-17 | 0.36 | 8.55 | 5.63 | 7.74 |
| E-18 | 0.05 | 8.73 | 6.12 | 8.15 |
| C-1 | 0.99 | 7.79 | 5.49 | 6.57 |
| C-2 | 0.54 | 7.29 | 4.50 | 5.99 |
| C-3 | 3.11 | 7.11 | 4.37 | 4.64 |

The above results show that the vinyl copolymers with polyimide copolymers shows print forces below 10 newton. Pops for these polymers is also low and compares favorably with the comparison copolymers C-1–C-3.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a dye layer and on the other side a slipping layer comprising a polyvinyl-block-siloxane copolymer, the polysiloxane component comprising from about 2 to about 30 weight % of said copolymer, and the polysiloxane component having a molecular weight of at least about 3900.

2. The element of claim 1 wherein said polyvinyl-block-silicone copolymer is derived from a vinyl monomer and a macroazo polydimethylsiloxane initiator.

3. The element of claim 1 wherein said polyvinyl blocks have a Tg of greater than about 100° C.

4. The element of claim 1 wherein said polyvinyl-block-siloxane copolymer contains recurring units having the structural formula:

$$+A+-+B+$$

wherein:

A represents a vinyl polymer; and

B represents a group having the structural formula:

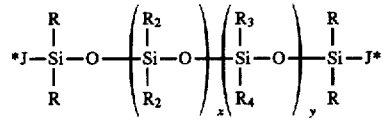

wherein:

each J represents

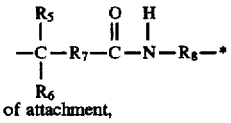

* represents the point of attachment,

R, $R_1$, $R_2$, $R_3$, and $R_4$ each independently represents a substituted or unsubstituted alkyl or fluoroalkyl group having from 1 to about 5 carbon atoms, or a substituted or unsubstituted aryl group having from 6 to about 12 carbon atoms;

$R_5$ and $R_6$ each independently represents a substituted or unsubstituted alkyl group having from 1 to about 5 carbon atoms, a substituted or unsubstituted aryl group having from 6 to about 12 carbon atoms, a halogen, or cyano;

$R_7$ and $R_8$ each independently represents a substituted or unsubstituted alkyl group having from 1 to about 5 carbon atoms, a substituted or unsubstituted aryl group having from 6 to about 12 carbon atoms; and the values of x and y are each from 0 to about 400, with the proviso that x+y is from 50 to about 400.

5. The element of claim 4 wherein A represents an acrylate, methacrylate, acrylamide, styrene, hydroxystyrene, vinyl pyrollidinone, maleic anhydride, N-substituted maleimides or vinyl ether.

6. The element of claim 4 wherein R, $R_1$, $R_2$, $R_3$, $R_4$ and $R_5$ are each methyl, $R_6$ is cyano, $R_7$ is —$CH_2CH_2$—, and $R_8$ is —$CH_2CH_2CH_2$—.

7. A process of forming a dye transfer image comprising:

(a) imagewise-heating a dye-donor element comprising a support having on one side thereof a dye layer and on the other side a slipping layer comprising a lubricating material, and (b) transferring a dye image to a dye-receiving element to form said dye transfer image, wherein said slipping layer comprises a polyvinyl-block-siloxane copolymer, the polysiloxane component comprising from about 2 to about 30 weight % of said copolymer, and the polysiloxane component having a molecular weight of at least about 3900.

8. The process of claim 7 wherein said polyvinyl-block-silicone copolymer is derived from a vinyl monomer and a macroazo polydimethylsiloxane initiator.

9. The process of claim 7 wherein said polyvinyl blocks have a Tg of greater than about 100° C.

10. The process of claim 7 wherein said polyvinyl-block-siloxane copolymer contains recurring units having the structural formula:

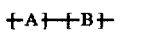

wherein:

A represents a vinyl polymer; and

B represents a group having the structural formula:

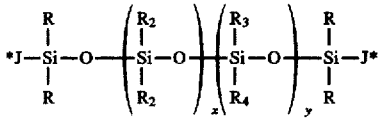

wherein:

each J represents

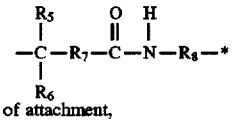

* represents the point of attachment,

R, $R_1$, $R_2$, $R_3$, and $R_4$ each independently represents a substituted or unsubstituted alkyl or fluoroalkyl group having from 1 to about 5 carbon atoms, or a substituted or unsubstituted aryl group having from 6 to about 12 carbon atoms;

$R_5$ and $R_6$ each independently represents a substituted or unsubstituted alkyl group having from 1 to about 5 carbon atoms, a substituted or unsubstituted aryl group having from 6 to about 12 carbon atoms, a halogen, or cyano;

$R_7$ and $R_8$ each independently represents a substituted or unsubstituted alkyl group having from 1 to about 5 carbon atoms, a substituted or unsubstituted aryl group having from 6 to about 12 carbon atoms; and the values of x and y are each from 0 to about 400, with the proviso that x+y is from 50 to about 400.

11. The process of claim 10 wherein A represents an acrylate, methacrylate, acrylamide, styrene, hydroxystyrene, vinyl pyrollidinone, maleic anhydride, N-substituted maleimides or vinyl ether.

12. The process of claim 10 wherein R, $R_1$, $R_2$, $R_3$, $R_4$ and $R_5$ are each methyl, $R_6$ is cyano, $R_7$ is —$CH_2CH_2$—, and $R_8$ is —$CH_2CH_2CH_2$—.

13. A thermal dye transfer assemblage comprising (a) a dye-donor element comprising a support having on one side thereof a dye layer and on the other side a slipping layer comprising lubricating material, and (b) a dye receiving element comprising a support having thereon a dye image-receiving layer, said dye-receiving element being in a superposed relationship with said dye-donor element so that said dye layer is in contact with said dye image-receiving layer, the improvement wherein said lubricating material comprises a polyvinyl-block-siloxane copolymer, the polysiloxane component comprising from about 2 to about 30 weight % of said copolymer, and the polysiloxane component having a molecular weight of at least about 3900.

14. The assemblage of claim 13 wherein said polyvinyl-block-silicone copolymer is derived from a vinyl monomer and a macroazo polydimethylsiloxane initiator.

15. The assemblage of claim 13 wherein said polyvinyl blocks have a Tg of greater than about 100° C.

16. The assemblage of claim 13 wherein said polyvinyl-block-siloxane copolymer contains recurring units having the structural formula:

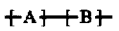

wherein:

A represents a vinyl polymer; and

B represents a group having the structural formula:

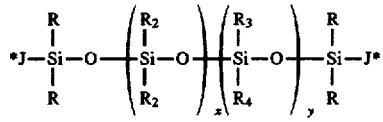

wherein:

each J represents

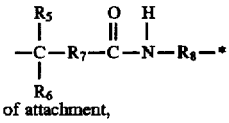

* represents the point of attachment,

R, $R_1$, $R_2$, $R_3$, and $R_4$ each independently represents a substituted or unsubstituted alkyl or fluoroalkyl group having from 1 to about 5 carbon atoms, or a substituted or unsubstituted aryl group having from 6 to about 12 carbon atoms;

$R_5$ and $R_6$ each independently represents a substituted or unsubstituted alkyl group having from 1 to about 5 carbon atoms, a substituted or unsubstituted aryl group having from 6 to about 12 carbon atoms, a halogen, or cyano;

$R_7$ and $R_8$ each independently represents a substituted or unsubstituted alkyl group having from 1 to about 5 carbon atoms, a substituted or unsubstituted aryl group having from 6 to about 12 carbon atoms; and the values of x and y are each from 0 to about 400, with the proviso that x+y is from 50 to about 400.

17. The assemblage of claim 16 wherein A represents an acrylate, methacrylate, acrylamide, styrene, hydroxystyrene, vinyl pyrollidinone, maleic anhydride, N-substituted maleimides or vinyl ether.

18. The assemblage of claim 16 wherein R, $R_1$, $R_2$, $R_3$, $R_4$ and $R_5$ are each methyl, $R_6$ is cyano, $R_7$ is —$CH_2CH_2$—, and $R_8$ is —$CH_2CH_2CH_2$—.

* * * * *

UNITED STATES PATENT AND TRADEMARK OFFICE

CERTIFICATE OF CORRECTION

PATENT NO.: 5,627,130

DATED: May 6, 1997

INVENTOR(S): David B. Bailey and Linda Kaszczuk

It is certified that error appears in the above-identified patent and that said Letters Patent is hereby corrected as shown below:

On the title page, after item [22], insert
--Related U.S. Application Data
[63] Provisional Application Serial No. 60/002,960, filed August 30, 1995.--

In Column 1, line 4, insert
--CROSS REFERENCE TO RELATED APPLICATION
Reference is made to and priority claimed from U.S. Provisional Application Serial No. US 60/002,960, filed 30 August 1995, entitled SLIPPING LAYER FOR DYE-DONOR ELEMENT USED IN THERMAL DYE TRANSFER--.

Signed and Sealed this

Ninth Day of September, 1997

*Attest:*

*Attesting Officer*

BRUCE LEHMAN

*Commissioner of Patents and Trademarks*